United States Patent [19]

Schneider et al.

[11] Patent Number: 5,005,481

[45] Date of Patent: Apr. 9, 1991

[54] INFLATABLE BLADDER SUBMUNITION DISPENSING SYSTEM

[75] Inventors: Mark D. Schneider, Woodinville; Randy L. Hoskins, Bothell; Lyle D. Galbraith, Redmond; Gary L. Dusenberry, Bellevue, all of Wash.

[73] Assignee: Olin Corporation, Cheshire, Conn.

[21] Appl. No.: 370,978

[22] Filed: Jun. 26, 1989

[51] Int. Cl.[5] ..... F42B 12/58; B64D 1/02

[52] U.S. Cl. ..... 102/393; 102/489

[58] Field of Search ..... 102/393, 489

[56] References Cited

U.S. PATENT DOCUMENTS

| | | | |
|---|---|---|---|
| 2,972,946 | 2/1961 | Poulter | 102/393 |
| 3,461,801 | 8/1969 | Vitale et al. | 102/393 |
| 3,726,223 | 4/1973 | Moe | 102/475 |
| 3,865,034 | 2/1975 | Boulter et al. | 102/393 |
| 3,938,439 | 2/1976 | Walton | 102/393 |
| 4,558,645 | 12/1985 | Boeder et al. | 102/489 |
| 4,688,486 | 8/1987 | Hall et al. | 102/489 |
| 4,714,020 | 12/1987 | Hertsgaard et al. | 102/489 |
| 4,750,423 | 6/1988 | Nagabhushan | 102/393 |
| 4,807,534 | 2/1989 | Vockensperger et al. | 102/489 |
| 4,879,941 | 11/1989 | Repë et al. | 102/393 |

FOREIGN PATENT DOCUMENTS

| | | |
|---|---|---|
| 0265609A2 | 5/1988 | European Pat. Off. . |
| 2169067A | 7/1986 | United Kingdom . |
| 2202310A | 9/1988 | United Kingdom . |

*Primary Examiner*—David H. Brown

*Attorney, Agent, or Firm*—John R. Wahl; Bruce E. Burdick

[57] ABSTRACT

A submunition dispensing system is disclosed which includes inflatable bladders expandable from collapsed to inflated conditions in response to fluid pressure. The bladders are mounted in cavities of a carrier frame underlying subpacks of submunitions. The bladders lie adjacent to the support and central structures of the frame defining the cavities. Each bladder can be configured to have either an unpleated or a pleated configuration in the collapsed condition. The bladder can also be configured for expansion to an overall constant diameter outer shape or to a generally conical outer shape in the inflated condition. Expansion to the conical shape imparts a velocity gradient to the subpack. The dispensing system also includes retaining assemblies for releasably retaining the subpacks in the cavities against the collapsed bladders and a gas generator disposed in a passage of the central structure of the carrier frame. The gas generator is actuated at the proper instant to deliver pressurized fluid to the collapsed bladders expanding them from the collapsed to inflated conditions and causing ejection of the subpacks from the cavities.

7 Claims, 10 Drawing Sheets

INFLATABLE BLADDER SUBMUNITION DISPENSING SYSTEM

The present invention generally relates to weapon dispensing systems and, more particularly, is concerned with an inflatable metal bladder submunition dispensing system used for ejection and dispersion of submunitions.

Submunitions ejected and dispersed from a carrier vehicle such as an air-dropped or ground-launched missile are weapons commonly referred to as "cluster bombs". The basic objective of any cluster weapon is to achieve an effective ground pattern with the contained submunitions. The desired ground pattern is typically a uniform dispersal of submunitions over a circular area of a predetermined diameter. It is particularly important not to leave a void in the center of the pattern.

To achieve such submunition dispersal pattern, the dispensing system must be capable of delivering energy to the submunitions in a manner to yield a wide range of transverse (radial) submunition velocities. The velocities should range from zero (or slightly above) to a value high enough to yield the predetermined diameter pattern. There are many proven prior art systems which can impart relatively high dispersal velocities to submunitions. However, there are no such systems which impart a wide range of velocities simultaneously.

Prior art dispensing systems developed for submunition dispersal have used an inflatable fabric bag. This bag has either a cylindrical or a generally rectangular box shape. The sides are generally parallel to a central axis through the bag. The cylindrical or rectangular fabric bag system does not produce variable velocities in the submunitions. Further, inflatable fabric bags have limitations regarding their pressure and temperature capabilities.

For example, the german MLRS-AT2 warhead uses an inflatable membrane system to disburse submunitions. The membrane is inflated from a stowed folded position to a cylindrical shape by a gas generator. Gas leakage is prevented by the proximity of the membrane to flat bulkheads of the warhead. The submunitions are all ejected at uniform velocity.

A method of providing a velocity gradient to submunition dispersal was developed by the assignee of the present invention. In &:his design an inflatable bag having parallel sides is positioned behind a stack of submunitions resting on an elongated support arm. One end of the support arm is pivotally secured, the other free to rotate outward in response to expansion of the inflatable bag. Upon inflation of the bag by the gas generator, each of the submunitions is dispersed at a velocity depending on its position in the stack along the length of the support arm. However, this design is relatively complex.

Consequently, there is a need for a simpler approach to dispensing submunitions or cluster weapons at variable velocities which will achieve the desired dispersal pattern while at the same time being able to withstand higher pressures and temperatures.

The present invention provides a submunition dispensing system which satisfies the aforementioned needs. The dispensing system of the present invention employs inflatable structures called "bladders". These bladders are preferably made of fabric or metal. Metallic bladders, have significantly higher pressure and temperature capabilities than fabric bladders and, hence, can produce a much higher dispersion velocity than fabric bladders.

The fabric and metallic bladders of the dispensing systems according to the present invention preferably have nonparallel sides to produce a velocity gradient in the disbursed submunitions. The final inflated shape of the bladders generally tapered, can be tailored to produce desired specific velocity gradients in the submunitions during the dispensing event which in turn leads to more uniform and efficient ground patterns. A pear or conical shape, for example, may produce an optimum dispersal pattern depending on the particular application. Also, the final inflated shape may be tailored to compensate for a nonsymmetrical center of mass of the submunition being ejected.

The present invention is directed to a single or multiple event submunition dispensing system for use with a carrier frame of a vehicle, such as an air-dropped or ground-launched missile. The carrier frame preferably has a central structure defining an elongated passage and a plurality of support structures radially projecting outwardly from the central structure. These support structures define a plurality of open elongated cavities circumferentially disposed about and axially extending along the central structure. The cavities of the carrier frame are for stowing a plurality of elongated subpacks of munitions therein.

Each metal or fabric bladder is expandable from a collapsed condition to an inflated condition in response to fluid pressure. One or more bladders, in the collapsed condition, are mounted in one or more of the cavities adjacent to and along the support and central structures of the carrier frame. Each bladder preferably underlies one or more subpacks disposed in the cavity.

Each bladder can be configured to have either an unpleated or a pleated configuration in the collapsed condition. The pleated configuration allows expansion through a longer stroke and can provide higher velocity differential than the unpleated configuration therefore imparting a higher maximum velocity to the subpack of munitions. The bladder can also be configured for expansion to an overall constant diameter full shape in the inflated condition. However, in order to impart a variable velocity gradient to the submunition subpack, the bladder is preferably configured for expansion to a conical shape.

Also, the dispensing system preferably includes a plurality of retaining assemblies for releasably retaining the subpacks in the cavities against the collapsed bladders. Each retaining assembly overlies one of the cavities and the subpack of munitions disposed therein. The assembly may include elongated retention bars which engage outer portions of the subpack generally parallel to the axis of the central structure and straps overlying the subpack circumferentially. The straps and bars may be releasably attached to the support structures.

Further, the dispensing system includes a fluid pressure-generating means, such as a gas generator, preferably disposed in the passage of the central structure of the carrier frame. The gas generator is connected in flow communication with the inflatable bladders by means such as orifices alone or connectors with orifices in the central structure. The gas generator is remotely actuated at the proper instant by an ignition interface in the carrier frame to deliver pressurized fluid to the collapsed bladders expanding them from the collapsed to inflated conditions and causing ejection of the subpacks from the cavities.

These and other features and advantages of the present invention will become apparent to those skilled in the art upon a reading of the following detailed description when taken in conjunction with the drawings wherein there is shown and described illustrative embodiments of the invention.

In the course of the following detailed description, reference will be made to the attached drawings in which.

Figure 1:
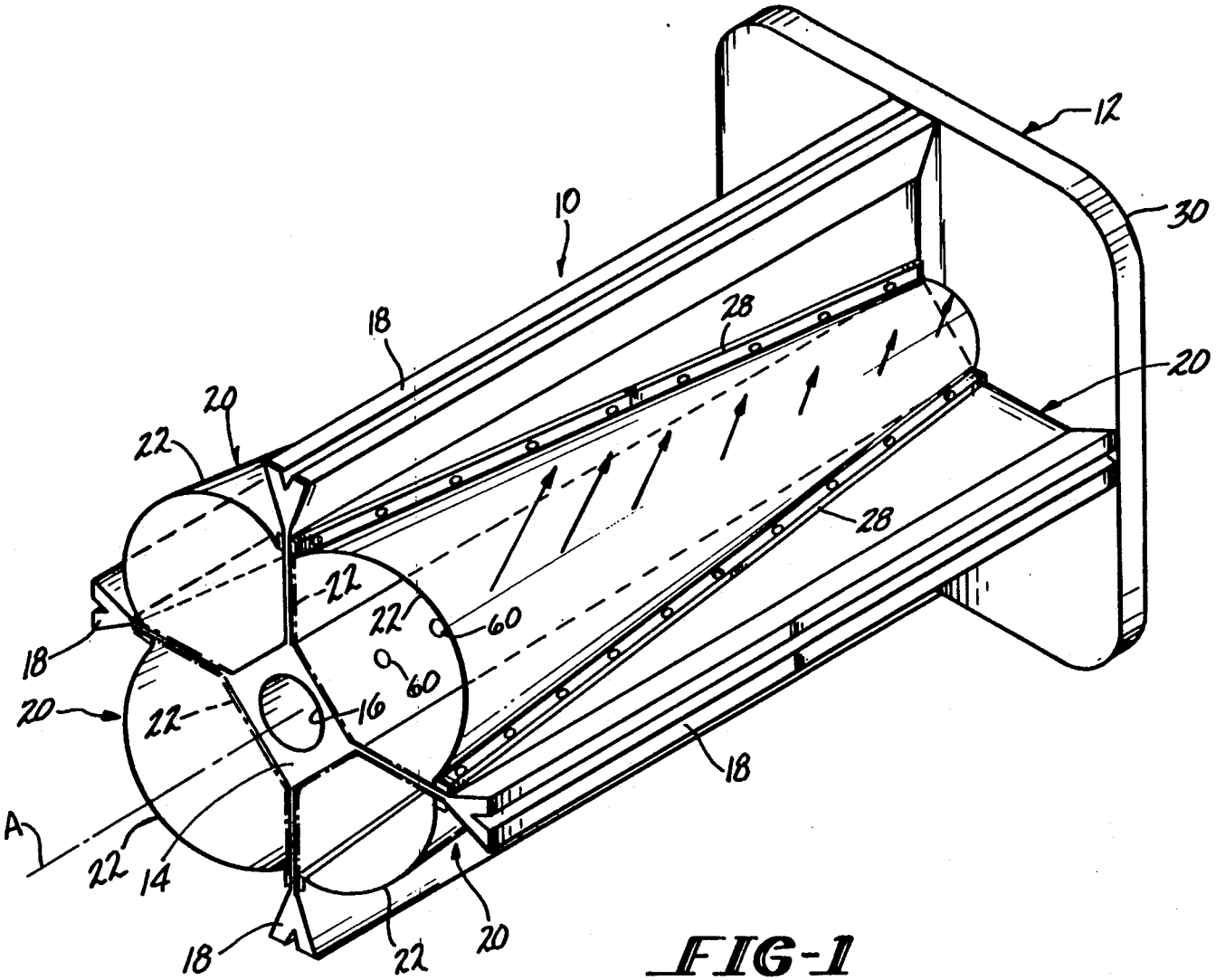
FIG. 1 is a perspective schematic representation of a single event submunition dispensing system of the present invention with one end structure removed and bladder inflated.
Figure 2:
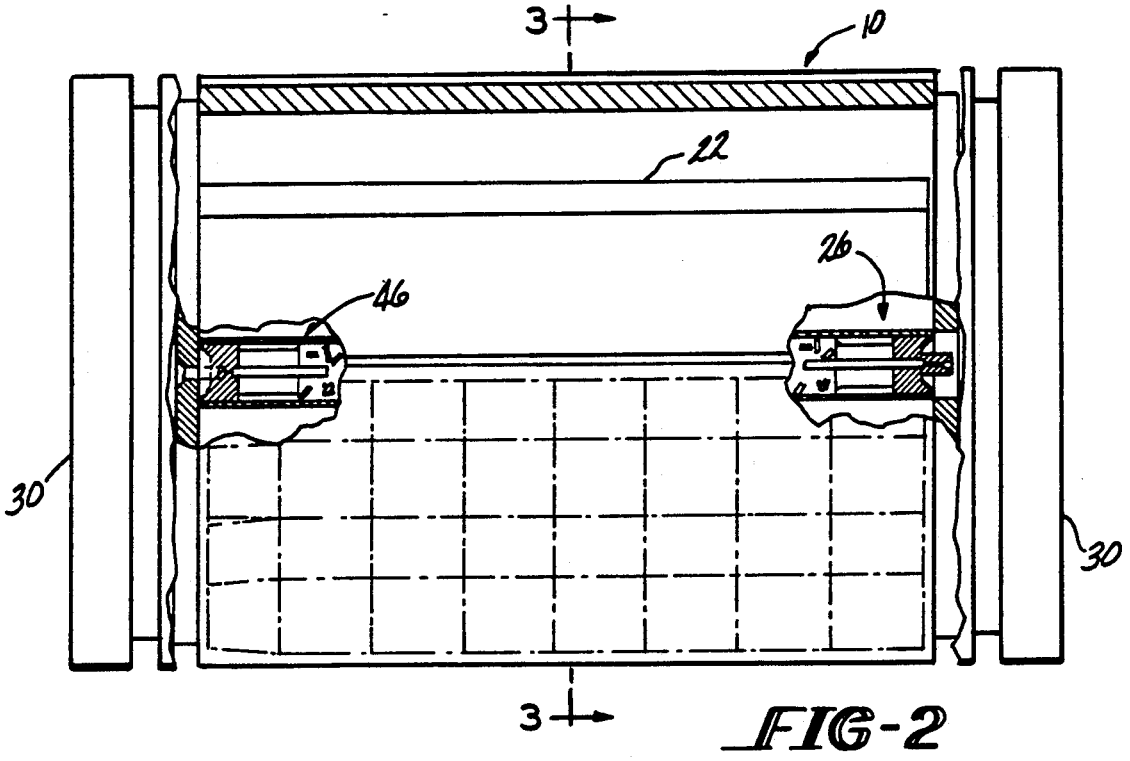
FIG. 2 is a side elevational view, with portions broken away and sectioned, of one embodiment of a single event dispensing system constructed in accordance with the present invention and employing four inflatable pleated full bladders.
Figure 3:
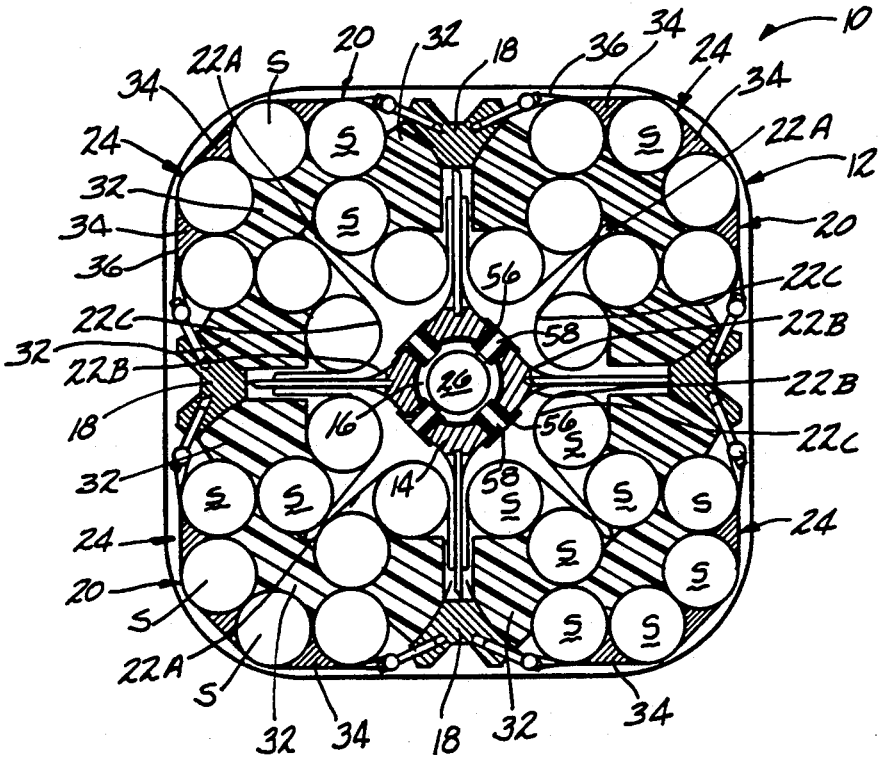
FIG. 3 is a cross-sectional view of the system taken along line 3—3 of FIG. 2.

Referring now to the drawings, and particularly to FIG. 1, there is shown a basic submunition dispensing system, generally designated by the numeral 10, having a construction in accordance with the present invention. In the Figures, like numbers are used to refer to like structures in the several illustrated embodiments.

The dispensing system 10 is illustrated in FIGS. 1–5 employed with a rigid carrier frame 12 of a launch vehicle, such as a bulkhead of an air-dropped or ground-launched missile. The carrier frame 12 has an overall cruciform configuration and basically includes an elongated central structure 14 defining an elongated passage 16 along central axis A and a plurality of support structures 18 connected to and radially projecting outwardly from the central structure 14. The central structure 14 and multiple support structures 18 together define a plurality of open elongated cavities 20. The cavities 20 are thereby circumferentially disposed about and axially extend along the central structure 14. A plurality of elongated subpacks S of munitions are stowed in each cavity 20.

The dispensing system 10 of FIGS. 1–5 is a single event system as is the dispensing system 10A of FIGS. 7–12. The dispensing system 10B shown in FIGS. 13–19 is a dual event system as will be subsequently described. Basically, each of the submunition dispensing systems 10–10B includes a plurality of inflatable metallic bladders 22, a plurality of retaining means 24, and a fluid pressure-generating means 26. The metallic bladders 22 are expandable bodies of thin metal, for instance, 0.010 to 0.050 inch thick stainless steel or aluminum. Alternatively, the bladders may be made of a strong fabric such as Kevlar and coated with a plastic or an elastomeric material such as silicone rubber to minimize gas passage through the fabric.

The bladders 22 are preformed in a stored or collapsed condition (for instance, as shown in dashed line form in FIG. 1) in which each nests within one of the cavities 20 between and with the munition subpack S therein and the center and support structures 14, 18 of the frame 12 defining the cavity 20. The preformed body of the bladder 22 in all embodiments is expandable in an outward direction from the central axis A of the carrier frame 12 through a submunition ejecting stroke to an inflated condition (shown in solid line form in FIG. 1) in response to the force of fluid pressure against either the underside or the interior of the bladder 22 depending upon its configuration.

Figure 13:
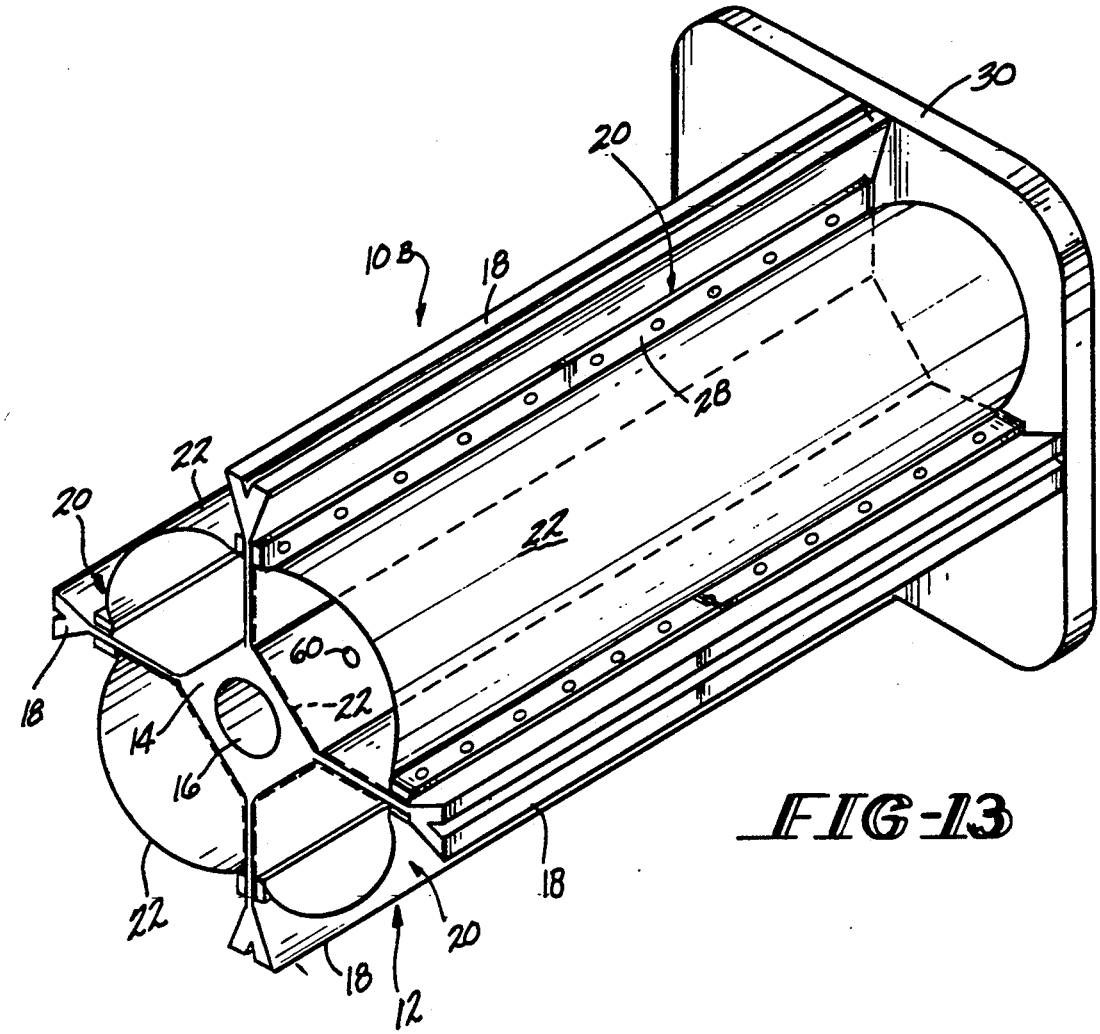
FIG. 13 is a perspective schematic representation of an ejecting subsystem of a dual event submunition dispensing system of the present invention.
Figure 14:
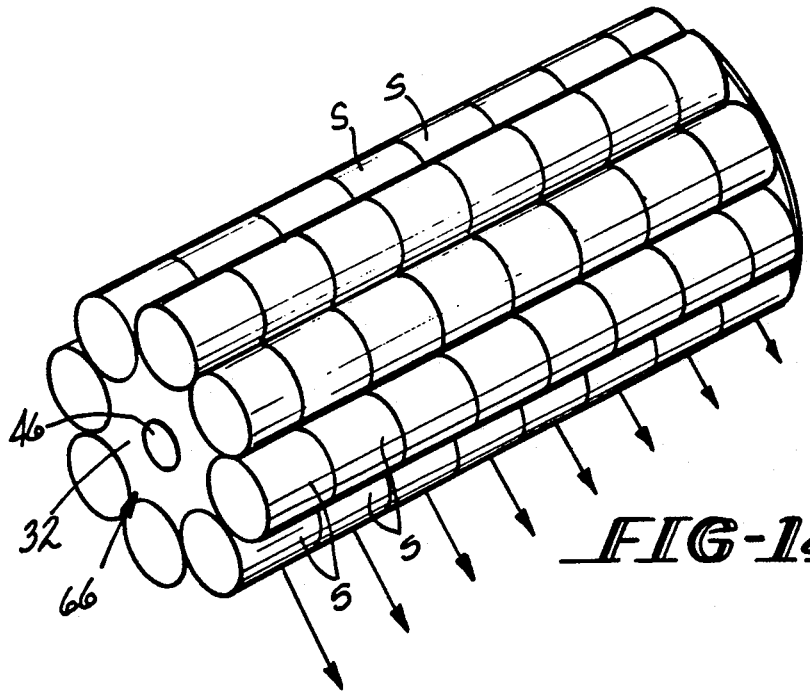
FIG. 14 is a perspective schematic representation of a dispersing subsystem of the dual event submunition dispensing system after occurrence of the ejecting event but before occurrence of the submunition dispersing event.
Figure 15:
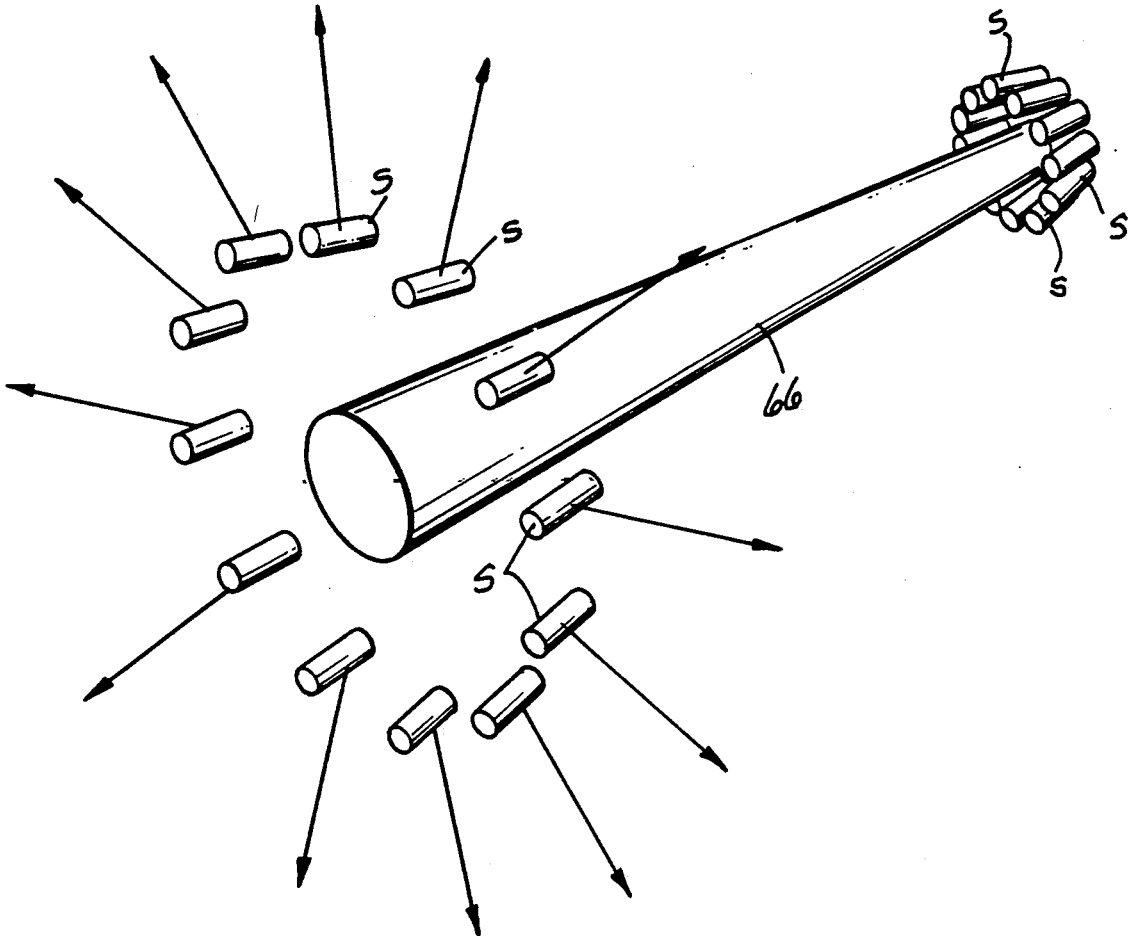
FIG. 15 is a perspective schematic representation of the dispersing subsystem of FIG. 14 after the dispersing event.
Figure 16:
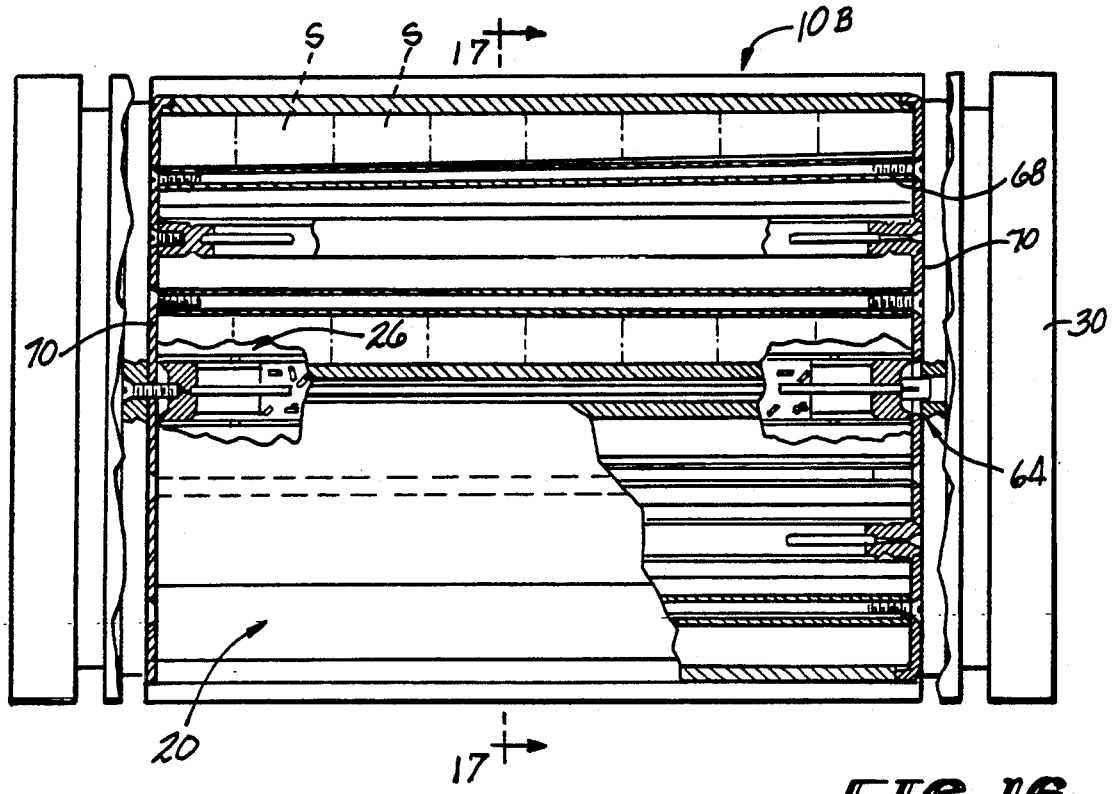
FIG. 16 is a side elevational view, with portions broken away and sectioned, of one embodiment of a dual event dispensing system constructed in accordance with the present invention and employing inflatable cylindrical full (symmetrical) bladders.
Figure 17:
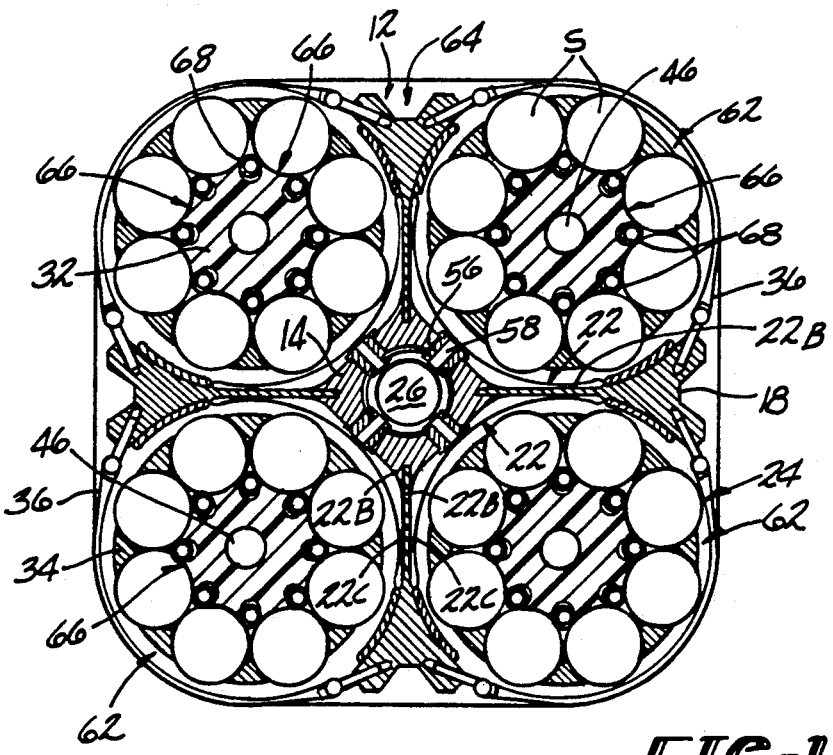
FIG. 17 is a cross-sectional view of the system taken along line 17—17 of FIG. 16.

The metallic bladders 22 of the dispensing systems 10–10B can have various configurations. In FIGS. 1 and 13, the bladder 22 has a generally flat, unpleated configuration in its preformed collapsed condition. In the embodiment shown in FIG. 4 and 5 the bladder 22 is pleated in its preformed collapsed condition. In each of these embodiments, bladder 22 is an elongated panel secured such as by any means through holes along its opposite longitudinal lateral edges by elongated bars 28 screwed to the pair of the support structures 18 forming the respective cavity 20. Alternatively, the edges may be formed in a wedge shape so as to engage support structures 18 in a dovetail fashion within an appropriate longitudinal groove (not shown).

Each bladder 22 may be configured in its collapsed condition for expansion to a conical shape in its inflated condition as in FIGS. 1, 4, 5, 7, 8 and 11.

The stroke of the bladder 22 in expanding to a conical shape imparts a variable velocity to the munition subpack S, i.e. a velocity that varies at successive points along its longitudinal extent. See the gradient velocity arrows in FIGS. 1, 8, 9 and 14. For example, the velocity imparted by the ejection stroke at the smaller diameter end of the bladder 22 might be ten feet per second, whereas the velocity imparted by the ejection stroke at the larger diameter end of the bladder 22 might be from sixty-five to one hundred feet per second. The variable velocity causes the subpack S to pitch outwardly relative to the forward direction of travel as it concurrently moves in a radial direction relative to the frame 12. Typically, the munition subpack S is composed of a row or stack of nested sublets. Due to the varying velocity at points along the subpack the sublets separate from one another after ejection from the cavity 22.

On the other hand, each metallic bladder 22 in the embodiments shown in FIG. 2, 3, 13, 17 and 19 is configured in its collapsed condition for expansion to an overall constant diameter shape, such as cylindrical, in the inflated condition. Thus, the stroke of the bladder 22 in expanding to a constant diameter shape imparts a uniform, constant velocity to the munition subpack S or the same velocity at successive points along its longitudinal extent.

In FIGS. 2-5, 7 and 11, each bladder 22 has a centrally pleated configuration at 22A in its preformed, collapsed condition. The pleated portion 22A of the bladder 22 extends outwardly between inner stacks of the munition subpacks S.

Further, in FIGS. 2, 3, 16 and 17, each bladder 22 is full, i.e. an elongated generally tubular body with inner and outer wall portions 22B, 22C that are disposed in a generally flattened relation with respect to one another in the preformed, collapsed condition of bladder. The full bladders are "open ended", relying upon the end structures 30 of the carrier frame 12, being rigidly attached at the opposite ends of the central and support structures 14, 18, as end seals during bladder expansion.

Figure 8:
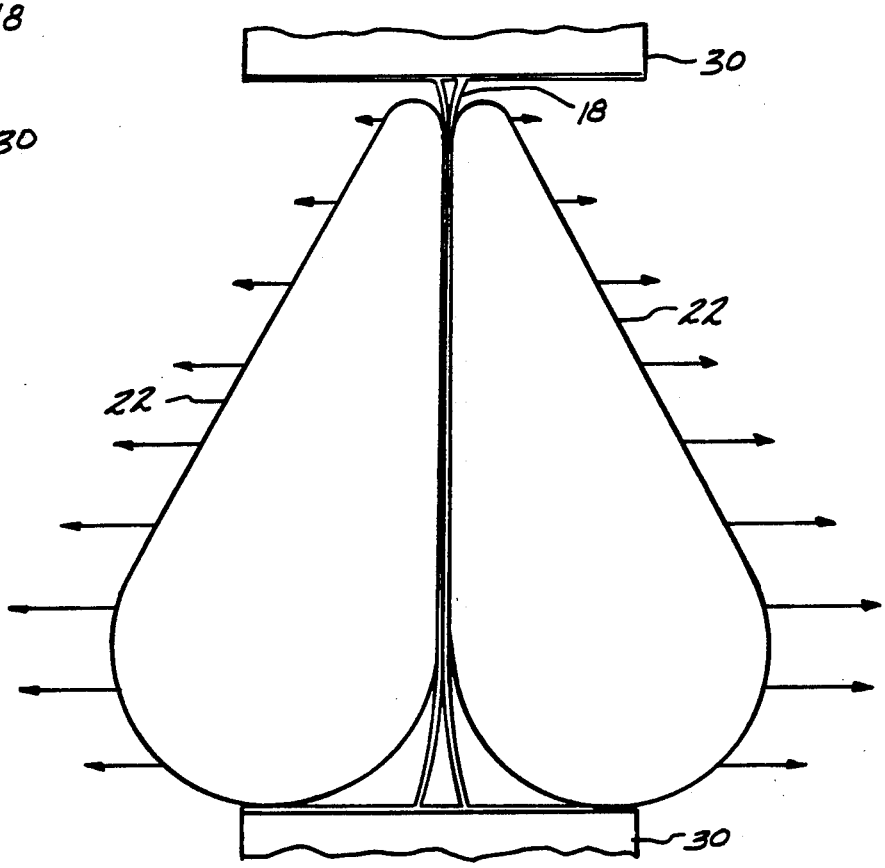
FIG. 8 is an enlarged schematic representation of the bladder of FIG. 7 after inflation.
Figure 7:
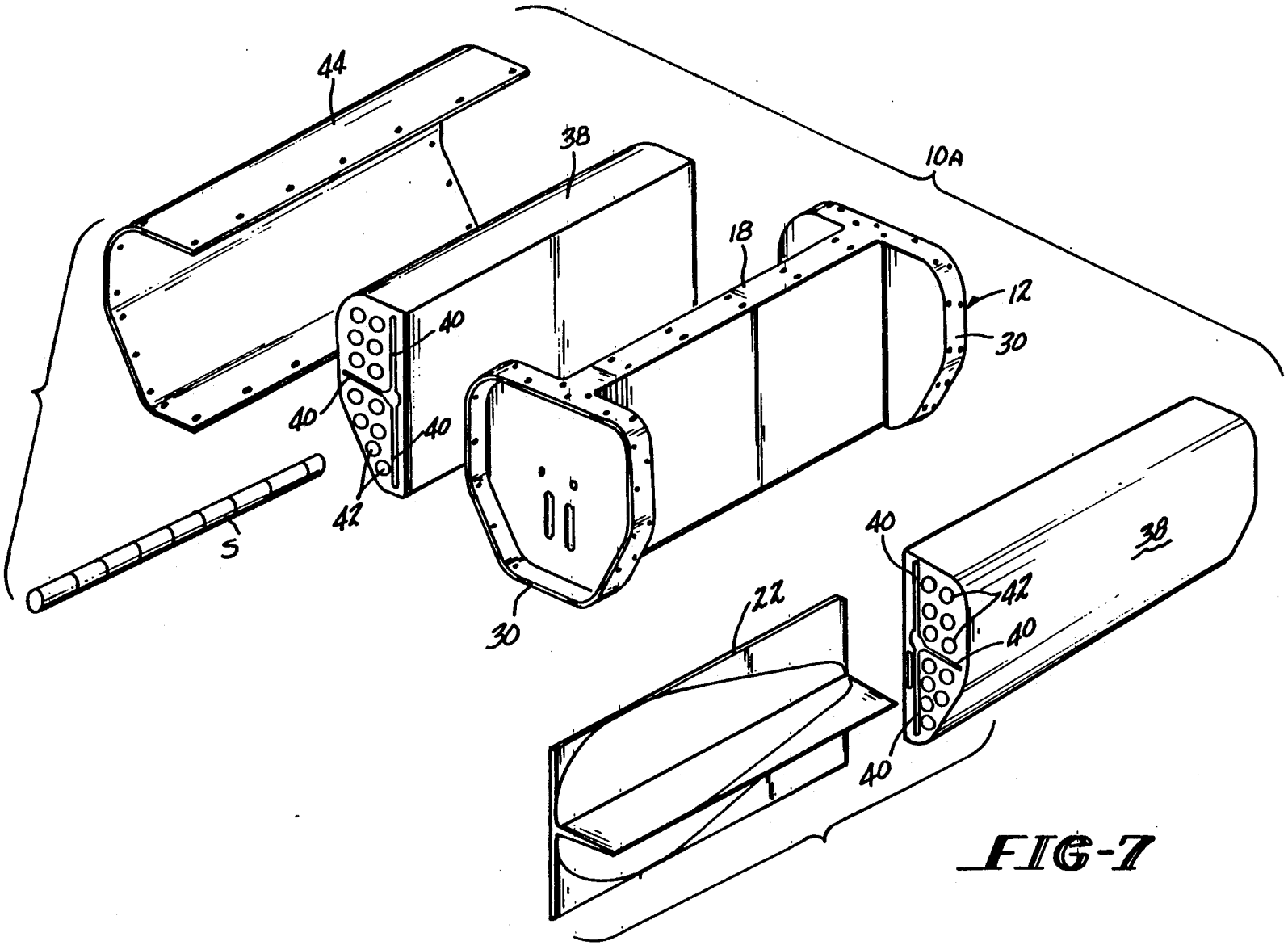
FIG. 7 is an exploded perspective view of still another embodiment of a single event dispensing system constructed in accordance with the present invention and employing bladders each having a three leaf configuration.
Figure 9:
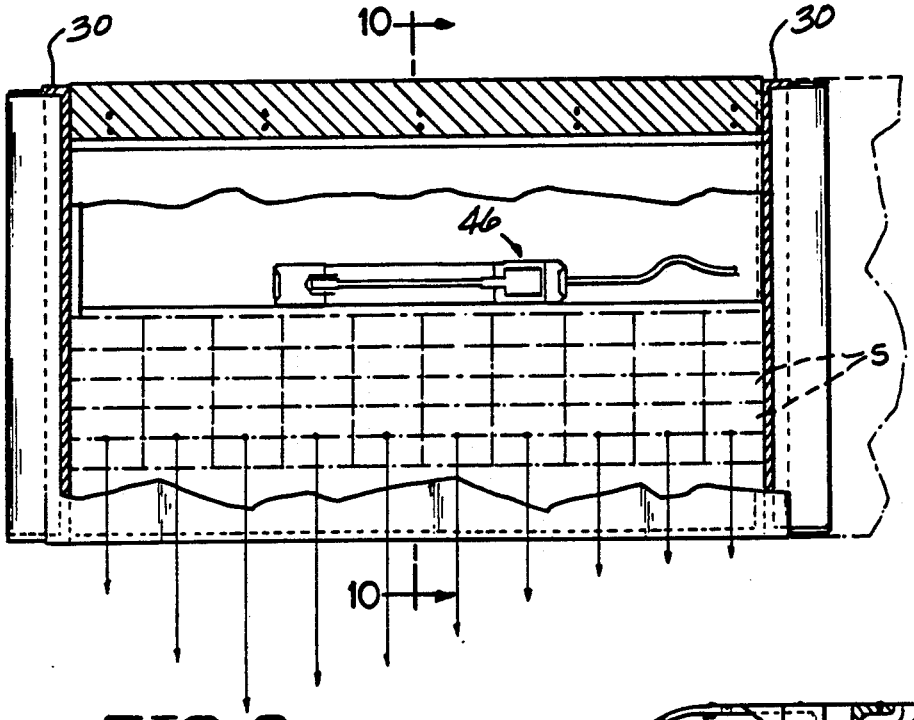
FIG. 9 is a side elevational view, with portions broken away and sectioned, of the dispensing system of FIG. 7 in assembled condition.
Figure 10:
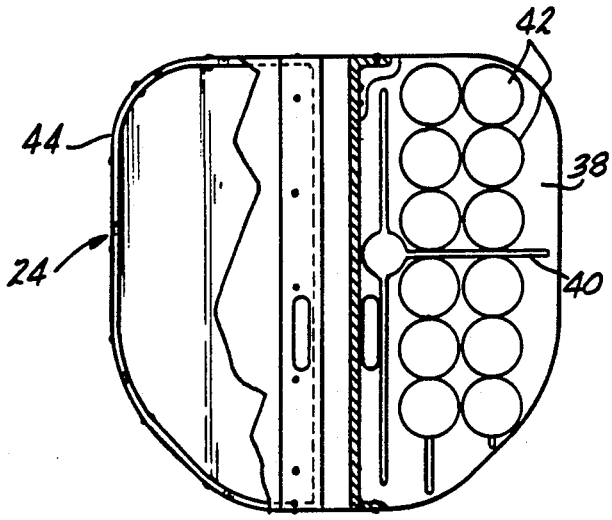
FIG. 10 is a cross-sectional view of the system taken along line 10—10 of FIG. 9.
Figure 11:
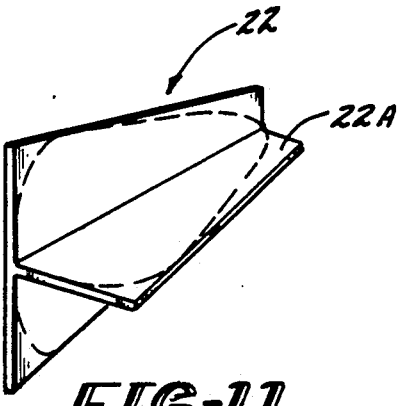
FIG. 11 is a perspective view of the bladder of system of FIG. 7, being shown by itself in the collapsed condition.
Figure 12:
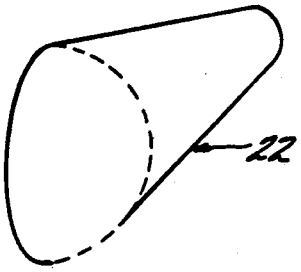
FIG. 12 is a perspective view of the profile of the bladder of FIG. 7 after being expanded to the inflated condition.

Alternatively, the metal or fabric bladders can be closed at their opposite ends as illustrated in FIG. 8. Each bladder 22 of FIGS. 7-11 has wall portions preformed in its collapsed condition in a generally flattened relation with respect to one another so as to define a body in having a generally three-leaf, or T-shaped, configuration.

Figure 4:
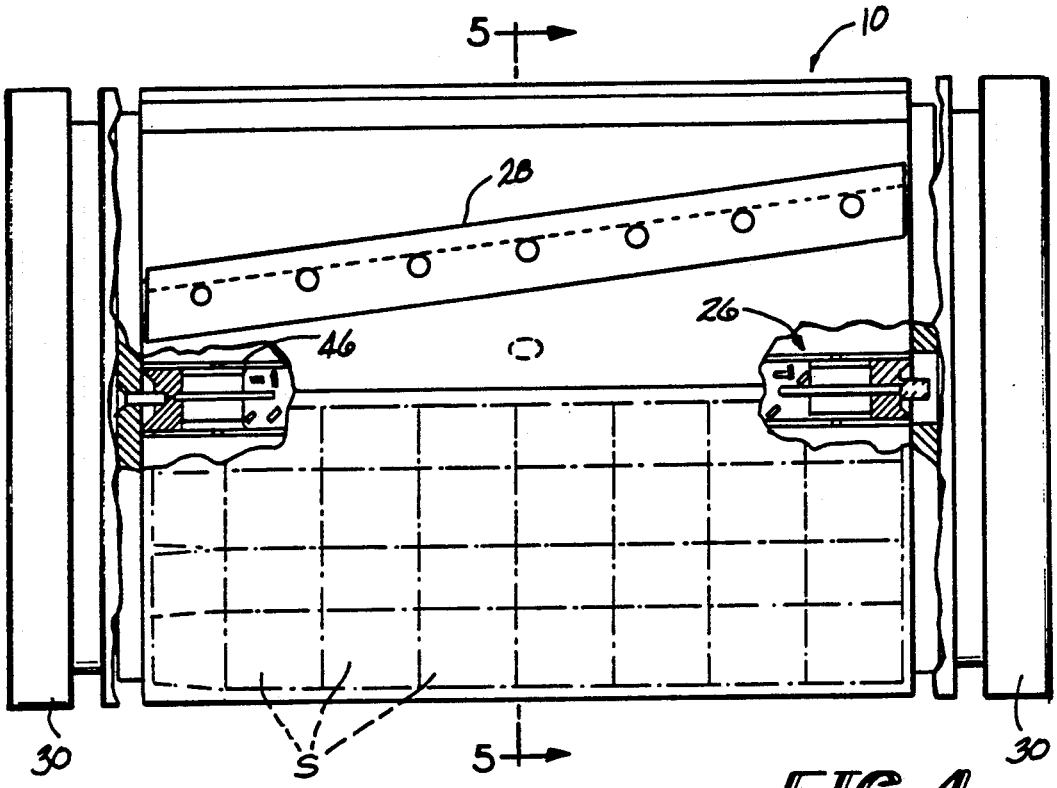
FIG. 4 is a side elevational view, with portions broken away and sectioned, of another embodiment of a single event dispensing system similar to the system of FIG. 2, but employing inflatable pleated partial bladders.
Figure 5:
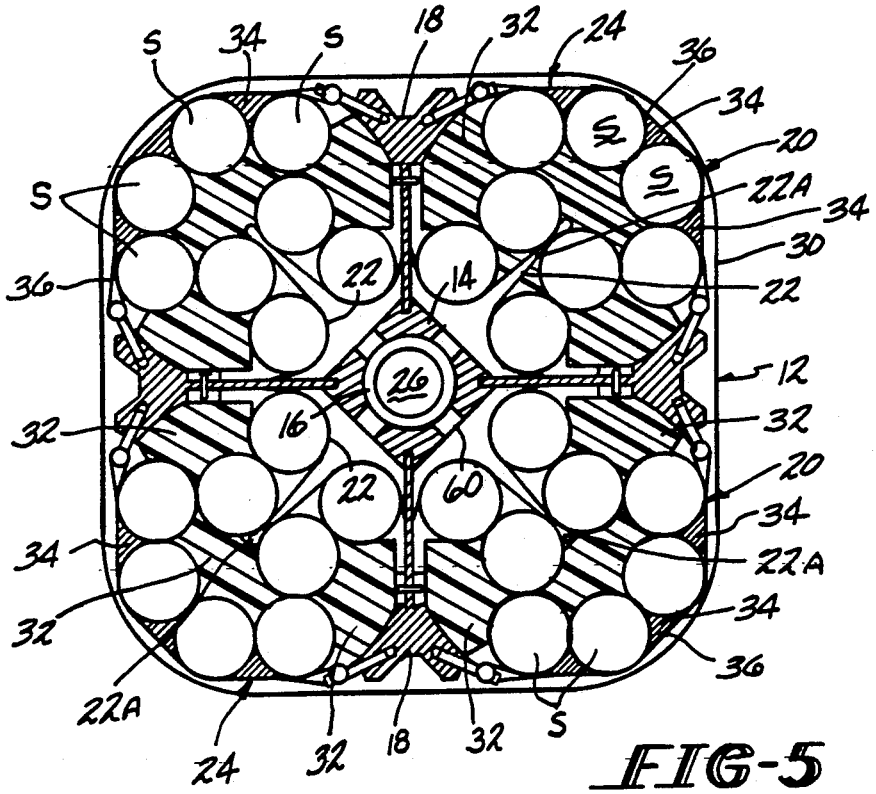
FIG. 5 is a cross-sectional view of the system taken along line 5—5 of FIG. 4.
Figure 18:
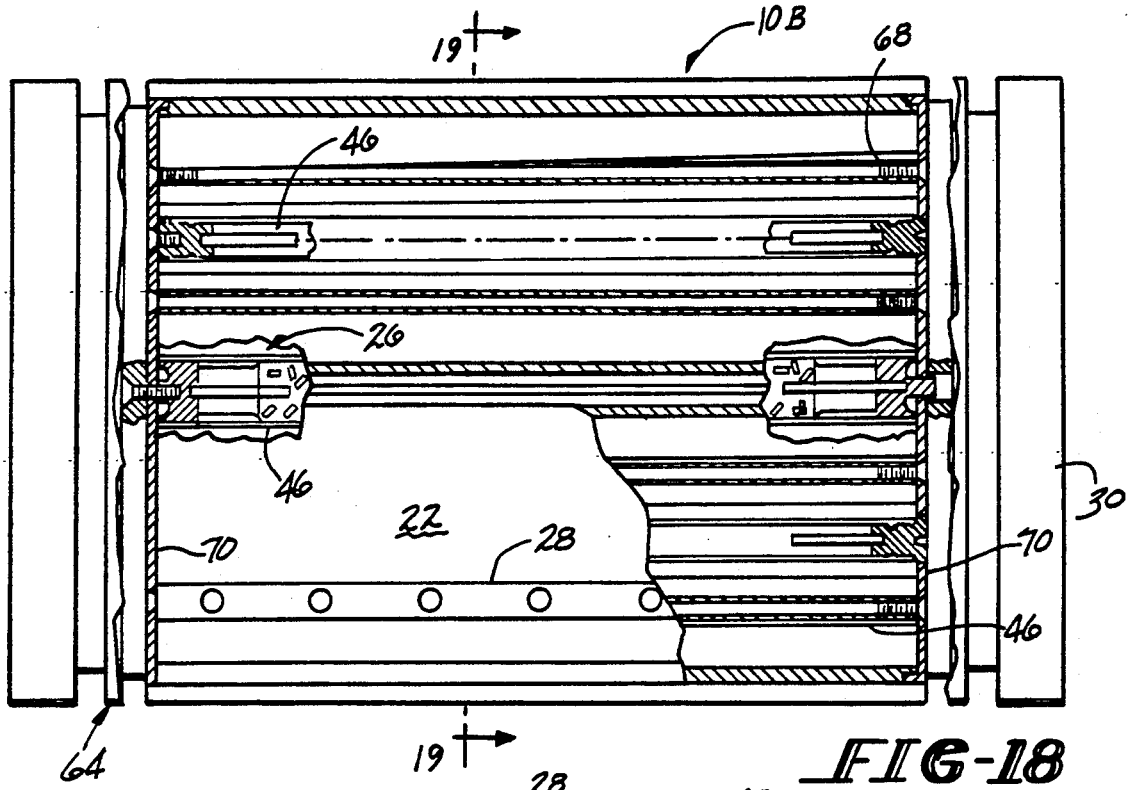
FIG. 18 is a side elevational view, with portions broken away and sectioned, of another embodiment of a dual event dispensing system similar to the system of FIG. 16, but employing inflatable unpleated partial bladders attached rigidly to the central structure.
Figure 19:
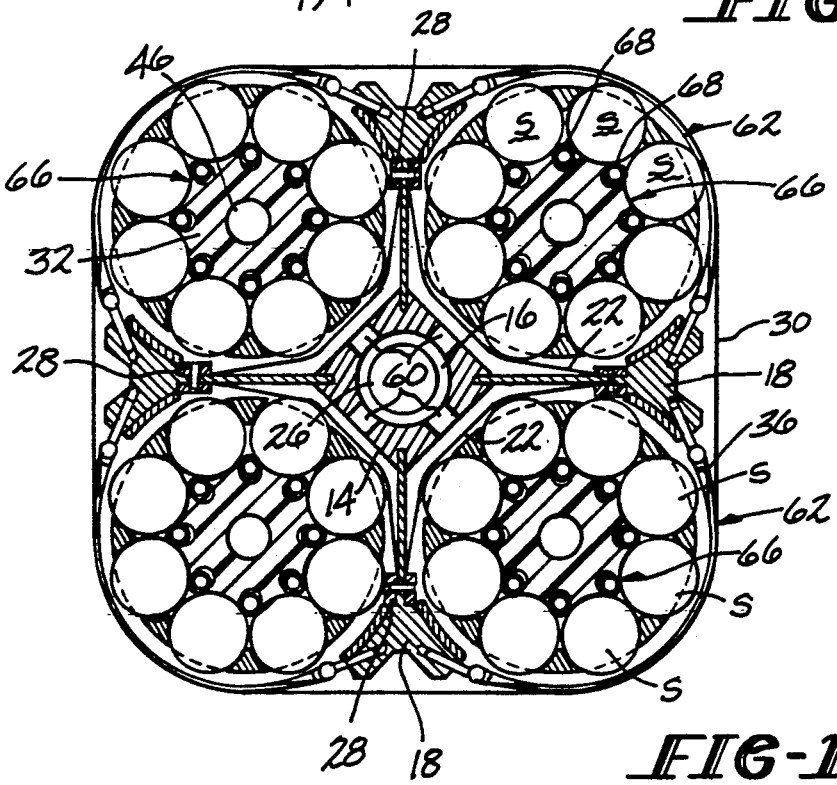
FIG. 19 is a cross-sectional view of the system taken along line 19—19 of FIG. 18.

The pleated bladder 22 in the embodiments shown in FIGS. 4 and 5 and the unpleated bladder 22 in FIGS. 18 and 19 are only partially expandable. The expandable portion is an elongated metal or fabric panel, having opposite longitudinal or lateral edges secured by elongated bars 28 attached to the support structures 18 of the frame 12, similar to the unpleated panels of the bladders 22 of FIGS. 1 and 13. Support structures 14 and 18 and ends 30 thus form the other sides of each of the bladders 22.

In each embodiment, each retaining means 24 of the submunition dispensing assembly 10 overlies a respective one of the cavities 20 and overlies and engages the subpacks S disposed therein and is releasably attached to the support structures 18. In such manner, the subpacks S are releasably retained in the cavities 20 against the bladders 22 in their collapsed conditions. More particularly, in the dispensing systems 10, 10B of FIGS. 2-5 and 16-19, each retaining means 24 includes a plurality of dunnage structures 32 interspersed between the subpacks S, a plurality of retention bars 34 engaged with outer portions of the subpacks, and one or more retention straps 36 overlying the subpacks and releasably attached at opposite ends to the support structures 18. The outward force imposed by the expanding bladder 22 is sufficient to rupture the straps 36 upon ejection of the munition subpacks S.

Each of the dunnage structures 32 may be any light weight rigid material such as a rigid foam to withstand the acceleration and dispersion pressures. The dunnage structure may also be within the bladder in designs where the submunition stacks are disbursed around the collapsed bladder. In this case, the dunnage structure also serves as a central support structure thus eliminating the need for a separate central structural support member.

On the other hand, in the dispensing system 10A of FIGS. 7-10, each retaining means 24 includes a molded rigid foam holder 38 having slots 40 and bores 42 joining slots 40 for mounting the bladders 22 and subpacks S in enclosed relation, and a preformed outer aerodynamic skin 44 releasably attached to the end structures 30 of the carrier frame 12 to cover the holders 38. The holders 38 are internally ribbed to provide stress risers for breakup and munition release when the bladders 22 are inflated. No explosive skin cutting device needs to be utilized to rupture the skin 44. Instead, due to the expanded conical shape of the bladders 22, the larger inflated diameter at the forward end would fail the leading edge of the skin 44 and then aerodynamic forces would assist in peeling the skin aft. The hemispherical-ended conical shapes assumed by the expanded bladders in this embodiment, illustrated in FIG. 8, provide the proper uniform density ground pattern with no center void.

Figure 6:
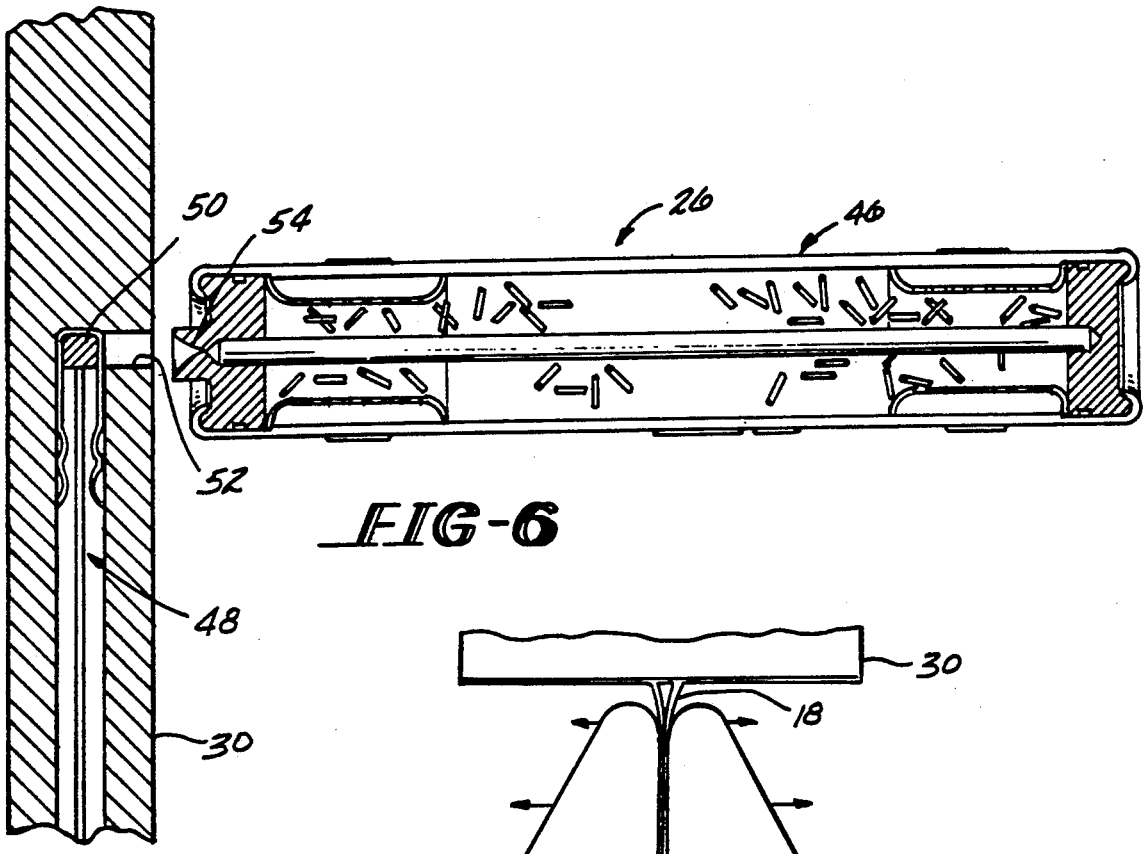
FIG. 6 is an enlarged fragmentary axial sectional view of the dispensing systems of FIGS. 2 and 4, showing a gas generator employed in the systems.

The fluid pressure-generating means 26 utilized in the embodiments of the dispensing systems 10-10B takes the form of a gas generator 46 mounted in the passage 16 of the central structure 14 of the carrier frame 12. As best seen in FIG. 6, one end structure 30 of the frame 12 contains a pyrotransfer line 48 with an end booster tip 50 adjacent an opening 52 in the end structure that is aligned with the axis of the gas generator 46. The interface between the pyrotransfer line 48 and the gas generator 46 is termed "air gap ignition". Upon booster tip function, the hot gas and shock wave output ruptures the end seal of the gas generator 46 and ignites the generator. There is a small orifice 54 between the interior of the generator 46 and the input port to minimize gas generator leakage back through the ignition path. This interface requires no mechanical hookup between the pyrotransfer line 48 and the gas generator 46.

In the various dispensing systems 10-10B, one gas generator 46 is connected in some manner in flow communication with each of the inflatable bladders 22. Thus, actuation of the gas generator 46 results in delivery of pressurized fluid (i.e., gas) to the bladders 22 to expand them from their collapsed to inflated conditions and cause ejection of the subpacks from the cavities.

In FIGS. 2, 3, 16 and 17, a plurality of connectors 56 with a flow orifices 58 defined therethrough are mounted to the central structure 14 and connected to the inner wall portion 22B of the respective bladders 22. Not only do the connectors 56 attach the bladders to the frame 12, but they also provide the pathway for pressurized gas from the generator 46 in the central passage 16 to the interiors of the bladders 22. On the other hand in the case of the bladder panels in FIGS. 1, 4, 5, 7, 9, 13, 18 and 19, flow orifices 60 are defined directly through the central structure 14 to provide the pathway for pressurized gas from the generator 46 to the undersides of the bladders 22.

The dual event submunition dispensing system 10B of FIGS. 13–19 differs from the single event dispensing systems 10, 10A of FIGS. 1–5 and 7–12 in that the dual event dispensing system 10B includes a plurality of dispersing subsystems 62 and an ejecting subsystem 64. The ejecting subsystem 64, shown in FIG. 13, has already been described above in conjunction with the single event system. Instead of ejecting a plurality of subpacks S, it ejects a plurality of dispersing subsystems 62 (shown in FIG. 14) which, in turn, each ejects the subpacks S which take the form of sublet stacks. The gas generators in the dispersing subsystems 62 are adjusted to ignite a preset time after ejection of the dispersing subsystems 62 by the ejecting subsystem 64 from the cavities 20 of the carrier frame. The dispersing subsystems 62, when clear of the carrier frame 12, eject the sublets in the pattern shown in FIG. 15.

Each dispersing system 62 is disposed in one of the cavities 20 of the frame 12 and includes an inflatable central dispersal member 66 generally similar to the bladders 22. The inflatable member 66 is preformed in a stored or collapsed condition and expandable in response to internal gas pressure to an inflated condition. The members 66 are generally tubular in shape and supported on tie rods 68 which extend between end plates 70. A dunnage structure 32 such as rigid foam is positioned within member 66 and forms a cavity for securing a gas generator 46.

Retaining means 24 similar to the retention bars 34 and straps 36 already described are used to retain the subpacks S to the central dispersal member 66 in the collapsed condition. The gas generator 46 in the center of each of the inflatable members 66 is actuated for delivering the pressurized fluid to the member 66 to expand it from its collapsed condition to an inflated condition to cause dispersion of the submunition stacks or subpacks therefrom as illustrated schematically in FIG. 15.

In these dual event embodiments shown in FIGS. 13–19, each inflatable metal bladder 22 of the ejecting subsystem 64 is configured in its collapsed condition for expansion to an overall constant diameter shape in the inflated condition. Thus, the dispersing subsystems 62 are ejected at uniform velocities. However, each inflatable member 66 of the dispersing subsystems 62 is configured in the collapsed condition for expansion to a conical shape in the inflated condition. The inflatable member 66 may be metal or silicone rubber coated Kevlar fabric. Thus, nested parts of the sublet stacks are ejected at variable velocities at successive points along the stacks.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof. For example, the designs exemplified by FIGS. 3, 5, 17 and 19 each need not be comprised of four quadrants. Any other number may be utilized consistent with available packaging constraints and remain within the scope of the present invention.

What is claimed is:

1. In combination with a carrier frame having a plurality of cavities disposed about and extending along a central axis of the frame, a submunition dispensing system comprising:

(a) a plurality of dispersing subsystems each disposed in one of said cavities of said frame, each subsystem including an inflatable central dispersal member expandable from a collapsed to an inflated condition in response to fluid pressure against said member disposed in said collapsed condition for supporting a plurality of elongated submunition stacks thereabout, first means for retaining the submunition stacks to said central dispersal member in said collapsed condition, and a first fluid pressure-generating means being actuatable for delivering pressurized fluid to said member to expand it from said collapsed condition to said inflated condition and cause dispersing of the submunition stacks therefrom; and (b) an ejecting subsystem including a plurality of inflatable metallic bladders, each being expandable from a collapsed to an inflated condition in response to fluid pressure against said bladder and each being mounted in said collapsed condition to said frame in one of the cavities so as to underlie one of said dispersing subsystems disposed therein, second means for releasably retaining the said dispersing subsystems in said cavities adjacent said bladders in said collapsed conditions, and second fluid pressure-generating means being actuatable for delivering pressurized fluid to said bladders to expand them from said collapsed to inflated conditions and cause ejection of said dispersing subsystems from said cavities.

2. The dispensing system as recited in claim 1, wherein each inflatable bladder of said ejecting subsystem has an unpleated configuration in said collapsed condition.

3. The dispensing system as recited in claim 1, wherein each inflatable bladder of said ejecting subsystem is configured in said collapsed condition for expansion to an overall constant diameter outer shape in said inflated condition.

4. The dispensing system as recited in claim 1, wherein each inflatable member of said dispersing subsystem is configured in said collapsed condition for expansion to a generally conical outer shape in said inflated condition.

5. The dispensing system as recited in claim 1, wherein at least one inflatable bladder of said ejecting subsystem is an elongated panel having opposite lateral edges attached to the frame.

6. The dispensing system as recited in claim 1, wherein at least one inflatable bladder of said ejecting subsystem is an elongated enclosed body with inner and outer wall portions disposed in a generally flattened relation with respect to one another in said collapsed condition of said bladder.

7. The dispensing system as recited in claim 6, wherein at least one inflatable bladder of said ejecting subsystem further includes a connector with a flow orifice defined therethrough, said connector being mounted to said inner wall portion of said body.

* * * * *